US006368143B1

(12) United States Patent
Adams

(10) Patent No.: US 6,368,143 B1
(45) Date of Patent: Apr. 9, 2002

(54) MODULAR PLUG WITH TWO PIECE HOUSING

(75) Inventor: Joshua Adams, Manchester, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 09/502,275

(22) Filed: Feb. 11, 2000

Related U.S. Application Data

(60) Provisional application No. 60/119,978, filed on Feb. 12, 1999.

(51) Int. Cl.[7] ..... H01R 4/24
(52) U.S. Cl. ..... 439/418; 439/426
(58) Field of Search ..... 439/417, 418, 439/425, 426, 676

(56) References Cited

U.S. PATENT DOCUMENTS 4,601,530 A 7/1986 Coldren et al.
5,147,215 A 9/1992 Pritulsky
5,194,014 A 3/1993 McClune et al.
5,505,638 A * 4/1996 Su et al. ..... 439/676
5,516,984 A 5/1996 Soes et al.
5,571,035 A 11/1996 Ferrill
5,628,647 A 5/1997 Rohrbaugh et al.
5,655,284 A 8/1997 Ferrill et al.
5,888,100 A 3/1999 Bofill et al.
6,007,368 A * 12/1999 Lorenz et al. ..... 439/418

* cited by examiner

*Primary Examiner*—Renee Luebke
(74) *Attorney, Agent, or Firm*—Cantor Colburn LLP

(57) ABSTRACT

An enhanced performance modular plug with a two piece housing is provided. The plug comprises a plurality of contact members each having an insulation displacement contact (IDC) end and a distal end. A first housing portion includes a plurality of slots for receiving the distal end of the plurality of contact members, a first latching assembly for mating the plug with a telecommunications outlet, and a second latching assembly. A second housing portion includes a first end for receiving the second latching assembly and a second end for receiving a cable, the first end having a plurality of channels for receiving a plurality of wires disposed in the cable.

17 Claims, 6 Drawing Sheets

MODULAR PLUG WITH TWO PIECE HOUSING

CROSS-REFERENCE TO RELATED APPLICATIONS

This application claims the benefit of U.S. provisional patent application serial No. 60/119,978 filed Feb. 12, 1999, the entire contents of which are incorporated herein by reference.

BACKGROUND OF THE INVENTION

The invention relates generally to an enhanced performance connector and in particular, to a plug, which is designed for enhanced performance.

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. New standards are being developed continuously and currently it is expected that future standards will require transmission requirements of at least 600 MHZ.

The above referenced transmission requirements also specify limits on near-end crosstalk (NEXT). Often, telecommunications connectors utilize pairs of conductive elements commonly known in the art as ring and tip conductors. As telecommunications connectors are reduced in size, adjacent pairs of conductive elements are placed closer to each other creating crosstalk between adjacent pairs.

Existing connecting devices include plugs, which are connected to outlets. These plugs can suffer from crosstalk as the rate of transmission increases. To comply with the near-end crosstalk requirements load bars are often utilized to distance the pairs of tip and ring connectors from one another thusly reducing or eliminating NEXT.

A typical plug comprises an upper and lower housing, a load bar, terminals having insulation displacement contacts (IDC) to maximize density and ease of use, and a strain relief member. The load bar includes at least one group of channels extending inside of the load bar. The IDC's are positioned in the upper housing with the cutting edges aligned with a plurality of wire receiving channels within the load bar. The load bar is placed in the lower housing. The cable jacket is stripped exposing the pairs of wires. The end of each pair of wires is untwisted and then inserted through a designated channel within the load bar including the channels extending inside of the load bar. The strain relief member is then connected to and engages the cable sheath to hold the cable tightly. The upper and lower housings are then mounted together punching down the wires into the cutting edges of the IDC.

The assembly of the plug is made difficult because of the location of the channels within the load bar and the small diameters of the wire inserted within the channels. The diameter of the wires is typically on the order of 22 to 28 American Wire Gauge (AWG) and, the wires, having very little resistance to deformation, easily buckle upon insertion into the channels. Buckled or bent wire within the channels may easily get stuck and prevent proper passage of the wire through the load bar. Additionally, buckled wire can easily become twisted and, without a method of locating the wires within the plug, the separation of each wire from the others becomes random resulting in some wires being disposed close to, or overlapping the locations of other wires hence increasing NEXT.

The cross-sectional ends of the cable used in modular plug applications, as discussed herein above, are typically mirror images of each other requiring two distinct termination assembly procedures. Traditional load bar modular plugs do not accommodate for the mirror image orientation of the cables thus connection assembly is further inhibited.

SUMMARY OF THE INVENTION

An enhanced performance modular plug with a two piece housing is provided. The plug comprises a plurality of contact members each having an insulation displacement contact (IDC) end and a distal end. A first housing portion includes a plurality of slots for receiving the distal end of the plurality of contact members, a first latching assembly for mating the plug with a telecommunications outlet, and a second latching assembly. A second housing portion includes a first end for receiving the second latching assembly and a second end for receiving a cable, the first end having a plurality of channels for receiving a plurality of wires disposed in the cable.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
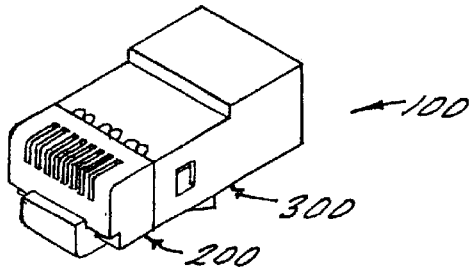
FIG. 1 is a perspective view of a plug in accordance with the present invention.
Figure 1A:
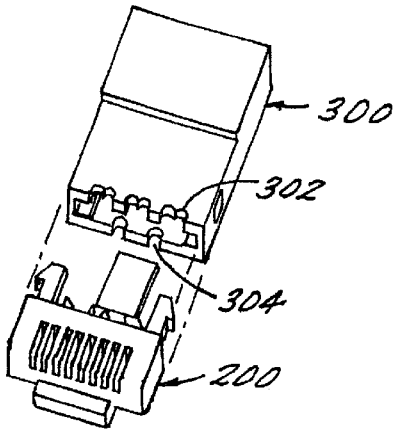
FIG. 1A is an exploded perspective view of the plug of FIG. 1.
Figure 2:
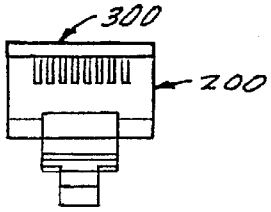
FIG. 2 is a front view of the plug of FIG. 1.
Figure 3:
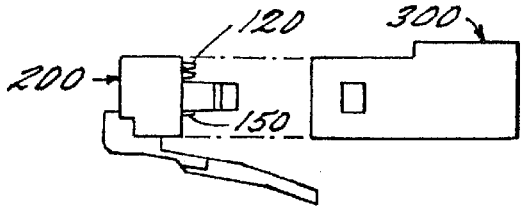
FIG. 3 is an exploded side view of the plug of FIG. 1.
Figure 4:
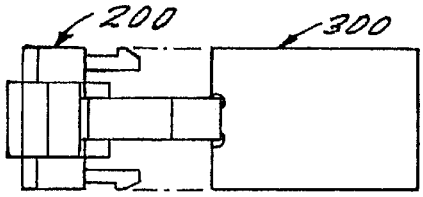
FIG. 4 is an exploded top view of the plug of FIG. 1.
Figure 5:
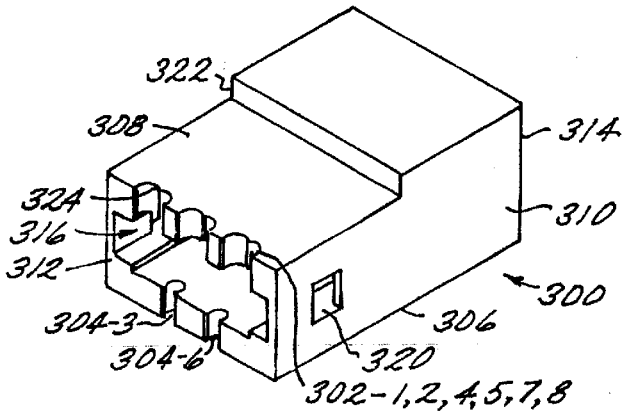
FIG. 5 is a perspective view of the conductor housing.
Figure 6:
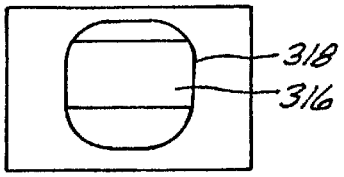
FIG. 6 is an end view of the conductor housing.
Figure 7:
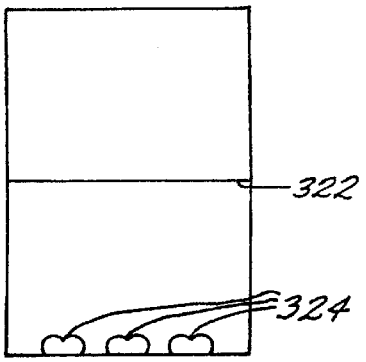
FIG. 7 is a top view of the conductor housing.
Figure 8:
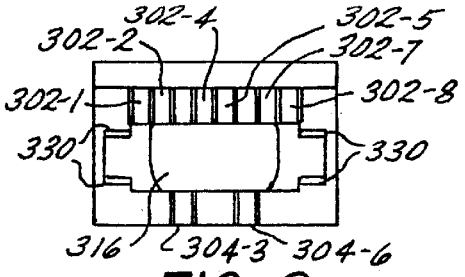
FIG. 8 is a front view of the conductor housing.
Figure 9:
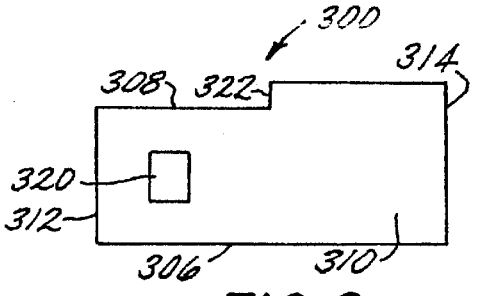
FIG. 9 is a side view of the conductor housing.

FIGS. 1–4 are views of an enhanced performance plug, shown generally at 100, in accordance with an exemplary embodiment of the invention. The plug 100 is designed to mate with RJ-45 outlets and includes a contact housing 200 that slides into and engages a conductor housing 300. Contact and conductor housings are preferably made from resilient plastic but may also be shielded as is known in the art. Contacts 120, 150 (FIGS. 15–22) are mounted in the contact housing 200. A plurality of spaced wire receiving channels 302, 304 included in a front face of the conductor housing receive wires and serve to position the wires in the proper location for termination on contacts 120, 150.

Figure 10:
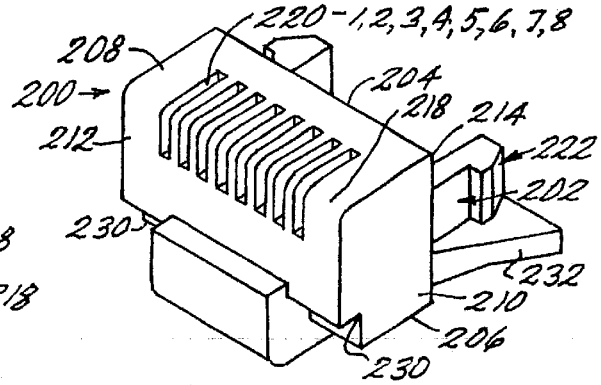
FIG. 10 is a perspective view of the contact housing.
Figure 13:
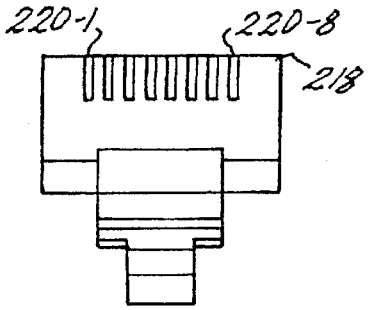
FIG. 13 is a front view of the contact housing.

Referring to FIGS. 5–8, the conductor housing 300 includes a lower planar surface 306, an opposing upper planar surface 308 and a pair of side walls 310. The surfaces 306, 308 and side walls 310 define opposing front and rear faces 312, 314 and a rectangular passage 316 extending from the front face 312 to a substantially circular cutout 318 of the rear face 314. The side walls 310 have openings 320 for receiving latches 202 that extend from a rear face 204 of the contact housing 200 to be described hereinafter (See FIG. 10). Rearwardly extending tapered portions 330 depend from the upper and lower planar surfaces 306, 308 at the front face 312 approximate the side walls 310 and extend rearwardly into the rectangular passage 316 to the openings 320 in the side walls for providing a guiding surface for the latches 202. The upper planar surface 308 includes a step 322 positioned substantially parallel to the front and rear faces 312 and 314, respectively.

Substantially semi-circular channels 302, 304 are formed in the upper planar surface 308 of the front face 312 and in the lower planar surface 306 of the front face 312 respectively. The diameter of each channel is a predetermined size smaller than the insulated conductor to be positioned within the channel and resiliently retained therein. The channels 302 in the upper planar surface 308 are positioned in pairs (i.e., tip and ring pairs) with each channel in the pair having a common edge 324 therebetween. Channels 302-1 and 302-2 define a pair. Channels 302-4 and 302-5 define a pair. Channels 302-7 and 302-8 define a pair. Three pairs of channels 302 in the upper planar surface 308 are equally spaced about the center of the front face 312 and offset from the two channels 304 at the lower planar surface 306, also equally spaced about the center of the front face 312. Channels 304-3 and 304-6 define a pair. The longitudinal axis of the channels 302, 304 is disposed 90 degrees to the planes of the upper and lower planar surfaces 306, 308. The staggered location of the lower and upper channels along with the special separation between the upper and lower surfaces increases the separation for minimizing NEXT as will be described hereinafter.

Referring to FIGS. 10–14, the contact housing 200 includes a lower planar surface 206, an opposing upper planar surface 208 and a pair of opposing side walls 210. The surfaces 206, 208 and side walls 210 define opposing front and rear faces 212 and 214, respectively. The dimensions of the surfaces 206, 208 and side walls 210 of the contact housing are of a predetermined size for providing an inserting locking engagement with the front face 312 of the conductor housing 300 as will be described in detail hereinafter. A chamfered edge 218 is positioned on the boundary between the upper surface 208 and the front face 212.

Eight slots 220 are defined at the chamfered edge 218 and are dispositioned perpendicular to an axis defined by the chamfered edge. The slots are aligned in accordance with industry standards for contact location to mate to a standard RJ-45 outlet. Each slot 220 is further aligned with an opposing wire receiving channel 302, 304 in the conductor housing 300 when the contact housing 200 is inserted into the conductor housing 300. In particular, slots 220-3 and 220-6 are aligned with the wire receiving channels in the lower planar surface 306 and receive IDC contacts 150 (see FIG. 19).

The slots 220-1, 2, 4, 5, 7, and 8 are a predetermined size to align and position contacts 120 (see FIG. 15) which are retained therein. The predetermined size and shape of each slot 220-1, 2, 4, 5, 7, and 8 is substantially equal to the height H1 and thickness T1 of an outlet contact end 122 of IDC contact 120.

Figure 15:
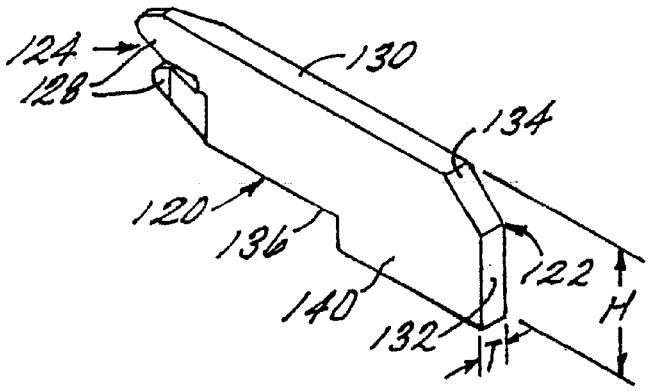
FIGS. 15–18 are views of a first contact.
Figure 16:
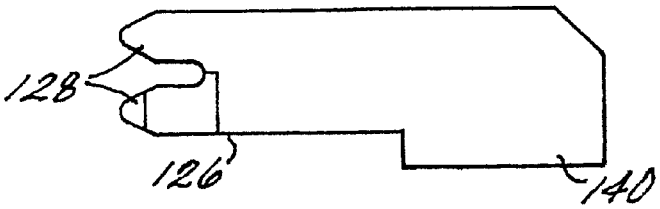
Figure 18:
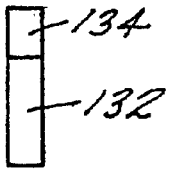
Figure 17:
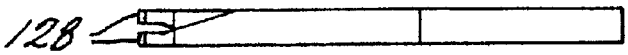
Figure 19:
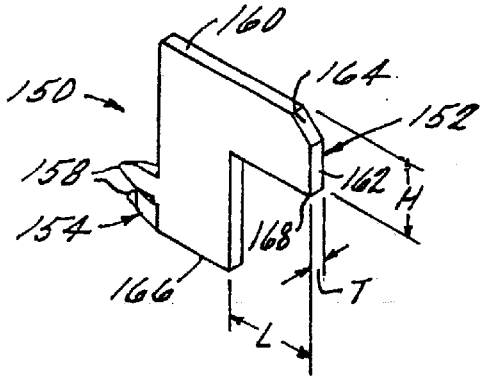
FIGS. 19–22 are views of a second contact.
Figure 20:
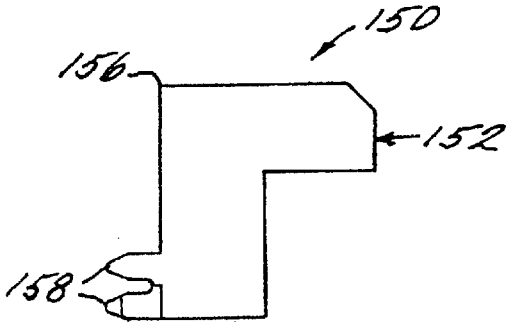
Figure 22:
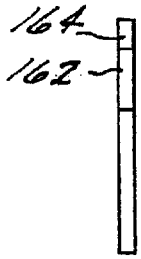
Figure 21:
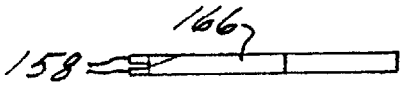

With the IDC contacts 120 positioned in their respective slots 220-1, 2, 4, 5, 7, and 8 and aligned as described hereinabove, IDC arms 128 extend past the slots 220-1, 2, 4, 5, 7, 8 and are aligned with their respective channels 302 (see FIG. 15).

Figure 11:
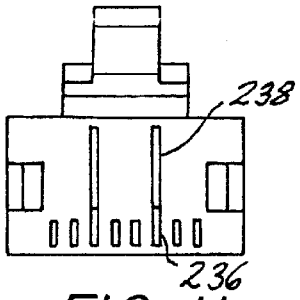
FIG. 11 is an end view of the contact housing.

The slots 220-3 and 6 are also a predetermined size to align and position contacts 150 (see FIG. 19) which are retained therein. The slots 220-3, 220-6 comprise a front portion 236 and a rear portion 238, as depicted in FIG. 11. The front portion 236 is a predetermined size and shape substantially equal to the length L, height H2 and thickness T2 of the outlet contact end 152 of IDC contact 150. The rear portion 238 is a predetermined size and shape substantially equal to size and shape of a rear portion of IDC contact 150. With the IDC contacts 150 positioned in their respective slots and aligned as described hereinabove, the IDC arms 158 extend past the slots 220-3, 6 and are aligned with their respective channels 304.

The outlet contact end 122, 152 of either IDC contact 120, 150 (see FIGS. 15, 19) is positioned within each slot 220. A distal surface 132, 162 of the outlet contact end 122, 152 is positioned approximate to and facing the front face 212 of the contact housing 200. A chamfered surface 134, 164 of the outlet contact end 122, 152 is dispositioned approximate to and facing the chamfered edge 218 of the contact housing 200. Thus, the upper surface 130, 160 of the IDC contact is aligned substantially parallel to the upper surface 208 of the contact housing 200.

Figure 12:
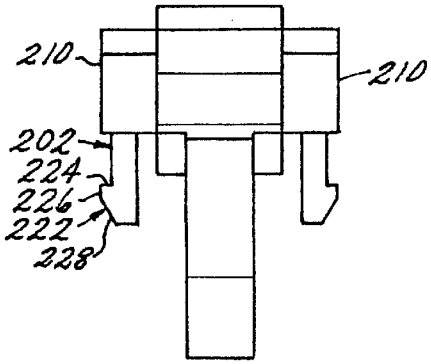
FIG. 12 is a top view of the contact housing.

Referring now to FIG. 12, latches 202, molded into the contact housing, extend from and beyond the rear face 214 of the contact housing 200 as described hereinbefore. The latches are of a predetermined size for insertion within the rectangular passage 316 of the conductor housing 300 (see FIG. 5). A locking portion 222 of each latch 202 includes an outwardly extending step 224 comprising a predetermined size generally equal to the size of the openings 320 in the side walls 310 of the conductor housing 300. A second surface 226 depends rearward a predetermined distance perpendicularly from the outwardly extending step 224. A third surface 228 extends rearward and angularly inward at a predetermined angle and a predetermined distance from the second surface 226. The predetermined dimensions of the second and third surfaces provide for insertion of the locking portion 222 in the openings 320 of the sidewalls 310 of the conductor housing 300 with the second surface 226 positioned substantially within the side walls 310 of the conductor housing 300.

Figure 14:
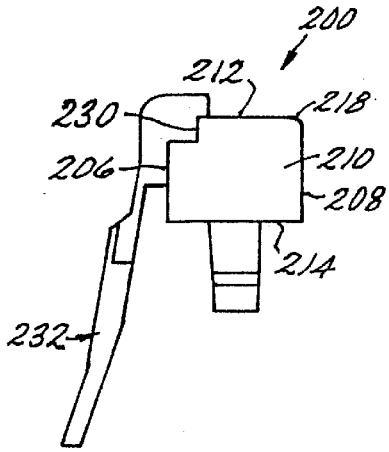
FIG. 14 is a side view of the contact housing.

A step 230 is defined at the boundary between the front face 212 and the lower planar surface 206 (see FIG. 14). A locking tongue 232 is attached at the step 230 and extends beyond the rear face 214 for locking the plug 100 to an outlet (not shown).

As best shown in FIGS. 15–22, first contact 120 and second contact 150 each includes an insulation displacement contact (IDC) end 124, 154 and an opposing outlet contact end 122, 152. The IDC end includes IDC arms 128, 158. An upper surface 130, 160 of the contact extends to the outlet contact end 122, 152. The outlet contact end 122, 152 includes a distal surface, 132, 162 and a chamfered surface 134, 164 extending from the upper surface 130, 160 thereto. All surfaces comprise a predetermined length. The geometry of the outlet contact end 122, 152 may comprise many other configurations as is well known in the art.

When positioned in the contact housing 200 the arms 128 of the IDC end 124 are substantially aligned with the midpoint of the opposing wire receiving channels 302-1, 2, 4, 5, 7, 8 on the upper planar surface 308 of the conductor housing 300 with the contact housing 200 affixed thereto. A lower surface 136 of the first contact 120 steps down to define a surface 140 substantially parallel to the upper surface 130 of first contact 120 although one skilled in the art would appreciate that the lower surface could include other shapes.

The IDC arms 158 are aligned with the midpoint of the opposing wire receiving channels 304-3 and 304-6 disposed on the lower planar surface 306 of the conductor housing 300 when the contact housing 200 is affixed to the conductor housing 300. The lower surface 166 of the contact 150 steps up to define a surface 168 substantially parallel to upper surface 160 of contact 150 although one skilled in the art would appreciate that surfaces 166, 168 could include other shapes.

When assembled, chamfered surfaces 134, 164 of the device outlet contact end 122, 152 are aligned in a row within slots and IDC ends 124, 154 are aligned with there respective channels as described hereinabove.

Figure 23A:
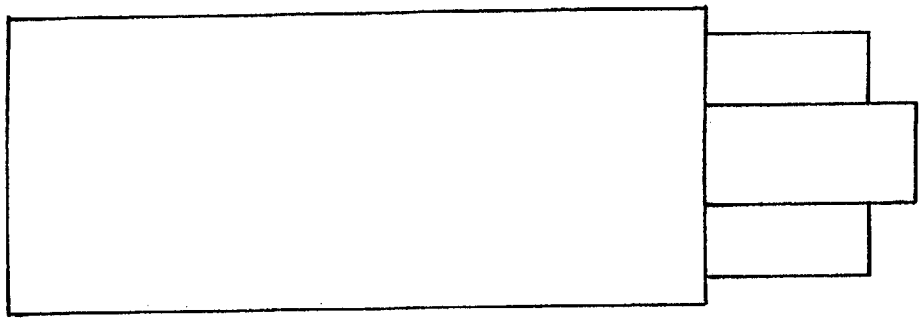
FIG. 23A is a side view of a cable.
Figure 23B:
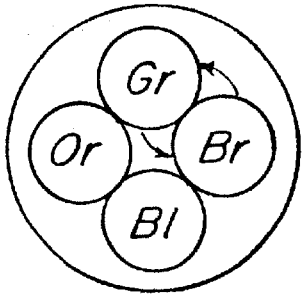
FIG. 23B is an end view of one end of the cable.
Figure 23C:
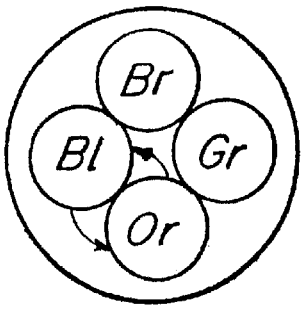
FIG. 23C is an end view of another end of the cable.

Installation of wires in the conductor housing 300 will now be described. FIGS. 23A and 23B are side and end views, respectively, of a cable having four pairs of wires. The four pairs are labeled Gr (green), Br (brown), Bl (blue) and Or (orange). Each pair includes two wires, one wire designated the tip conductor and the other wire designated the ring conductor. In the un-installed state, the individual wires of each pair are twisted (i.e. the tip and ring conductors are twisted around each other). FIG. 23C is an end view of the opposite end of the cable shown in FIG. 23B.

For the end of the cable shown in FIG. 23B, the channels 302, 304 in the conductor housing 300 will be loaded in the following way. First, the cable will be inserted in the rear face 314 and through passage 316 and out the front face 312. Then, the cable jacket will be stripped off approximately one and one-half inches from the end. Next, pairs Br and Gr will be swapped in position as shown in FIG. 23B. To do this, pair Gr will cross between pair Br and pair Bl. This will create a separation between pair Br and Bl. Pair Bl is referred to as a split pair because it is spread over an intermediate pair in conventional wiring standards. The tip and ring wires of the Bl pair will be untwisted up to a maximum of one-half inch from the cable jacket, such that the wires in the pair are oriented correctly. The Bl pair will then be pressed into wire receiving channels 304-3 and 304-6. The remaining pairs Or, Br and Gr will be untwisted as little as necessary and pressed into their appropriate wire receiving channels 302 such that no pairs are crossed. The tip and ring conductors for each pair are kept adjacent in wire receiving channels 302, 304. The wires are then trimmed as close to the upper and lower surfaces 306, 308 as possible. The wires are retained in the channels 302, 304 by the compression of the channels against the wires pressed therein resulting from the resilience of the channel material.

The pairs that are kept together, Or, Br and Gr are positioned in the upper wire receiving channels 302. The split pair Bl that straddles another pair Br, in accordance with conventional wiring standards, is pressed in the lower wire receiving channels 304-3, 304-6. The split pair Bl usually contributes greatly to near end crosstalk (NEXT). By distancing this pair from the other pairs the crosstalk generated by the split pair is reduced.

For the end of the cable shown in FIG. 23C the cable housing will be loaded in the following way. First, the cable will be inserted in the rear face 314 and through the passage 316 and out the front face 312. Then, the cable jacket will be stripped off approximately one and one-half inches from the end. Next pair Or and pair Bl will be swapped in position as shown in FIG. 23C. To do this, pair Or will cross between pair Br and pair Bl. This will create a separation between pair Br and the split pair Bl. The wires are then pressed in the channels 304, 306 on the front face 312 as described above.

Assembly of the plug will now be described. The outlet contact ends 122, 152 of contacts 120, 150 having insulation displacement ends 128, 158 facing rearward are positioned in the slots 220 of the contact housing 200. It is understood that the contacts for the split pair Bl positioned in the wire receiving channels 304-3, 304-6 will be the second contacts 150. The contact housing 200 is then inserted into the conductor housing 300 with the latches 202 entering the rectangular passage 316 and guided by the rearwardly extending tapered portions 330. As the contact housing 200 is inserted into the rectangular passage 316 of the conductor housing 300, the third surfaces 228 of the locking portion 222 of the latches 202 slide along the interior of the side walls 310 and are compressed thereby. The wire receiving channels 302, 304 receive the IDC arms 128, 158 wherein the IDC arms 128, 158 receive the wires and make electrical contact, as is well known in the art. Substantially simultaneously, the outwardly extending steps 224 of the locking portion 222 are received into the openings 320 in the side walls 310 locking therein, thus completing assembly of the plug 100.

Although an eight position plug has been described, it is within the skill of the art to construct variations embodying a ten position, a six position, a four position, and a two position modular plug.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications plug comprising:

a plurality of contact members having an insulation displacement contact end and a distal end;

a first housing portion having a plurality of slots for receiving said distal end of said plurality of contact members, a first latching assembly for mating said plug with a telecommunications outlet, and a second latching assembly; and a second housing portion having a first end for receiving said second latching assembly and a second end for receiving a cable, said first end having a plurality of channels for receiving a plurality of wires disposed in said cable;

wherein said first housing portion further comprises a front end and a rear end, said second latching assembly disposed on said rear end;

wherein said second latching assembly comprises a plurality of latch arms extending rearward from said first housing portion, said plurality of latch arms each comprising a latch step received by said second housing portion.

2. The telecommunications plug of claim 1 wherein said front end further comprises a chamfered edge at said slots.

3. The telecommunications plug of claim 2 wherein said distal end of said plurality of contact members comprises a chamfered surface for aligning with said chamfered edge of said first housing portion.

4. The telecommunications plug of claim 1 wherein said first latching assembly is disposed on said first housing portion proximate to said front end such that said first latch assembly extends angularly rearward from said first housing portion.

5. A telecommunications plug comprising:

a plurality of contact members having an insulation displacement contact end and a distal end;

a first housing portion having a plurality of slots for receiving said distal end of said plurality of contact members, a first latching assembly for mating said plug with a telecommunications outlet, and a second latching assembly; and a second housing portion having a first end for receiving said second latching assembly and a second end for receiving a cable, said first end having a plurality of channels for receiving a plurality of wires disposed in said cable;

wherein said first housing portion further comprises a front end and a rear end, said second latching assembly disposed on said rear end;

wherein said plurality of slots traverse longitudinally through said first housing portion from said front end to said rear end.

6. The telecommunications plug of claim 5 wherein said plurality of slots are of a plurality of sizes corresponding to sizes of said plurality of contact members.

7. A telecommunications plug comprising:

a plurality of contact members having an insulation displacement contact end and a distal end;

a first housing portion having a plurality of slots for receiving said distal end of said plurality of contact members, a first latching assembly for mating said plug with a telecommunications outlet, and a second latching assembly; and a second housing portion having a first end for receiving said second latching assembly and a second end for receiving a cable, said first end having a plurality of channels for receiving a plurality of wires disposed in said cable;

wherein said plurality of slots comprises eight slots disposed substantially parallel to one another said eight slots traversing through said first housing portion from a front end to a rear end.

8. A telecommunications plug comprising:

a plurality of contact members having an insulation displacement contact end and a distal end;

a first housing portion having a plurality of slots for receiving said distal end of said plurality of contact members, a first latching assembly for mating said plug with a telecommunications outlet, and a second latching assembly; and a second housing portion having a first end for receiving said second latching assembly and a second end for receiving a cable, said first end having a plurality of channels for receiving a plurality of wires disposed in said cable;

wherein said second housing portion further comprises a top member, a bottom member, a first sidewall, and a second sidewall disposed so as to create a passage therethrough;

wherein said plurality of channels comprises a first set of channels disposed on said top member at said first end of said second housing portion and a second set of channels disposed on said bottom member at said first end of said second housing.

9. The telecommunications plug of claim 8 wherein said first set of channels comprises a plurality of pairs of channels, each pair of channels for receiving a tip conductor and a ring conductor of said wires.

10. The telecommunications plug of claim 9 wherein said plurality of pairs of channels comprises three said pairs of channels.

11. The telecommunications plug of claim 8 wherein said second set of channels comprises a plurality of channels each for receiving either a tip conductor or a ring conductor.

12. The telecommunications plug of claim 11 wherein said plurality of channels comprises two said channels.

13. The telecommunications plug of claim 8 wherein said second housing portion further comprises a first notch and a second notch for receiving said second latching assembly.

14. The telecommunications plug of claim 13 wherein said first notch is disposed in said first sidewall and said second notch is disposed in said second sidewall.

15. The telecommunications plug of claim 8 wherein said first sidewall further includes a first tapered portion and said second sidewall further includes a second tapered portion, said first and said second tapered portions extending from said first end toward said second end.

16. The telecommunications plug of claim 8 wherein said plurality of contact members comprises a first set of contact members which are disposed in said plug extending from said plurality of slots to said first set of channels and a second set of contact members which are disposed in said plug extending from said plurality of slots to said second set of channels.

17. A telecommunications plug comprising:

a plurality of contact members having an insulation displacement contact end and a distal end;

a first housing portion having a plurality of slots for receiving said distal end of said plurality of contact members, a first latching assembly for mating said plug with a telecommunications outlet, and a second latching assembly; and a second housing portion having a first end for receiving said second latching assembly and a second end for receiving a cable, said first end having a plurality of channels for receiving a plurality of wires disposed in said cable;

wherein said second end includes an end member having a cutout for receiving said plurality of wires.

* * * * *